US006899647B2

(12) United States Patent
Chia

(10) Patent No.: US 6,899,647 B2
(45) Date of Patent: May 31, 2005

(54) REVERSIBLE FLOATING GAME

(76) Inventor: Francis See Chong Chia, 17 Kadoorie Ave, Kowloon, Hong Kong, Hong Kong (CN)

( * ) Notice: Subject to any disclaimer, the term of this patent is extended or adjusted under 35 U.S.C. 154(b) by 19 days.

(21) Appl. No.: 10/301,338

(22) Filed: Nov. 22, 2002

(65) Prior Publication Data

US 2004/0102260 A1 May 27, 2004

(51) Int. Cl.[7] ..... A63B 67/00
(52) U.S. Cl. ..... 473/466; 473/196; 273/350
(58) Field of Search ..... 473/472, 466, 473/470, 196, 157; 273/350, 338, 336, 394; 441/81, 131; 472/129, 128

(56) References Cited

U.S. PATENT DOCUMENTS

| | | | | |
|---|---|---|---|---|
| 3,134,594 A | | 5/1964 | Crowley | |
| 3,350,097 A | | 10/1967 | Chevrette et al. | |
| 3,403,907 A | * | 10/1968 | Keller | 273/350 |
| 3,430,958 A | | 3/1969 | Lakeman | |
| 3,469,844 A | * | 9/1969 | Sindelar | 273/350 |
| 3,582,078 A | * | 6/1971 | Katras et al. | 273/394 |
| 3,652,090 A | | 3/1972 | Semmens | |
| 3,656,749 A | * | 4/1972 | Reyes | 473/485 |
| 3,778,060 A | | 12/1973 | Lakeman | |
| 3,895,801 A | | 7/1975 | Baird | |
| 3,989,250 A | | 11/1976 | Lakeman | |
| 5,318,307 A | | 6/1994 | Bouchard et al. | |
| 5,421,585 A | * | 6/1995 | Ruvio | 273/338 |
| 5,620,185 A | | 4/1997 | Robertson | |
| 5,852,894 A | * | 12/1998 | Shannon et al. | 43/17 |
| 6,030,300 A | | 2/2000 | Zheng | |
| 6,173,957 B1 | | 1/2001 | James | |

OTHER PUBLICATIONS

Packaging and Photograph of Six Flags "Ring Toss 'N Hoops" Game. Date of Publication Unknown to Applicant, but Admittedly Precedes Present Invention.

* cited by examiner

*Primary Examiner*—Sebastiano Passaniti
*Assistant Examiner*—M. Chambers
(74) *Attorney, Agent, or Firm*—Frank Marino

(57) ABSTRACT

An apparatus for playing two games, one at a time, in a swimming pool. The apparatus comprises a floating support having first and second portions, a first game target disposed in the first portion and a second game target disposed in the second portion, wherein the support may be disposed first portion up or first portion down, and is shaped and arranged to float stably in either orientation, so that of the first or second games my be played accordingly.

9 Claims, 4 Drawing Sheets

REVERSIBLE FLOATING GAME

FIELD OF THE INVENTION

The present invention is a game-playing apparatus for use in water. More specifically, it is a floating target for use such as in a swimming pool or swimming area by participants in or adjacent to the water.

BACKGROUND AND DESCRIPTION OF THE PRIOR ART

Buoyant game-playing devices are well known in the prior art. Numerous games, and apparatuses for use in playing them, are made and have been made over the years for use by persons while swimming in or standing adjacent to a swimming pool.

Water polo includes two goals, one at each end of a pool. Each of two opposing teams of swimmers tries to throw a ball past the swimmers of the opposing team and into the opposing team's goal. In this game, the goals are fixedly attached to the solid walls at each end of the pool.

Devices for use in toss games, wherein a target or basket is floated in the pool and objects such as basketballs, disks or rings, are thrown at or into the target or basket, are shown in numerous prior art patents, such as 3134594, 3350097, 3403907, 3430958, 3469844, 3652090, 3656749, 3778060, 3895801, 3989250, 5318307, 5421585, 5620185, 6030300, and 6173957. Each of these devices is useful for playing just one game, and each is meant to be used in only one orientation.

A floating apparatus for playing both ring toss and basketball is manufactured under the Trademark "Six Flags" and called "Ring Toss 'N Hoops", which is used in only one orientation for playing either game. This apparatus floats entirely above the water surface and is found to be both unstable and prone to unintentional lateral movement during play.

No apparatuses are known to the inventor that are adapted for re-orientation to enable the playing of more than one game while maximizing the apparatus's stability and minimizing its inadvertent lateral movement.

Being that such prior art floating game devices have their useful portions above the water surface, it is additionally a common feature that they are constructed of floating components. Such devices therefore tend to be light and unstable. Not only are they prone to being tipped over during rough play, but also they tend to move laterally around the swimming area during even casual play. One common means for overcoming this deficiency is the use of an anchoring device. But such anchoring devices as are common in the prior art add complexity and cost to the device, and create a safety hazard due to the connecting lines they require.

It is therefore an object of the present invention to provide an improved floating game-playing apparatus that may be used to play more than one game.

It is a further object to provide such an apparatus that is more stable than floating game-playing apparatuses of the prior art.

It is a further object to provide such an apparatus that may be used effectively without an anchoring means.

It is a further object to provide a such an apparatus for use in a swimming pool or swimming area to allow a user to play either basketball or ring toss.

SUMMARY OF THE INVENTION

The present invention comprises a game-playing apparatus that is buoyant for use on the water surface of a swimming area, and that may be used in either a first or a second orientation. First and Second games may be played according to the orientation chosen.

In the preferred embodiment, the apparatus comprises a basketball hoop at a first end and a set of ring toss posts at the opposite, or second, end. The center of buoyancy of the apparatus provides that the apparatus floats stably, either when oriented with the basketball hoop directed upwardly or when the ring toss posts are directed upwardly. When the apparatus is accompanied with a basketball and a set of toss rings, the user may choose which of the two games he wishes to play and position the apparatus accordingly as it is floated in, for instance, a swimming pool.

An anchoring means, according to any of those employed with prior art floating game devices, may indeed be used with the present invention, but the construction of the apparatus renders the use unnecessary. The apparatus is ingeniously designed to straddle the water line, floating substantially half above, and half below, the water surface. The construction and arrangement of the apparatus allows water to be absorbed below the water line, and to drain above the water line, thereby lowering the apparatus' center of gravity and greatly increasing its stability and inertia. This not only prevents unwanted tip-over even during rough play, but also helps the apparatus maintain its lateral position even without the use of an anchoring device.

BRIEF DESCRIPTION OF THE DRAWINGS

FIG. 2 is a top perspective view of the apparatus of FIG. 1 in its basketball-playing orientation.

DETAILED DESCRIPTION OF THE PREFERRED EMBODIMENT

Figure 1:
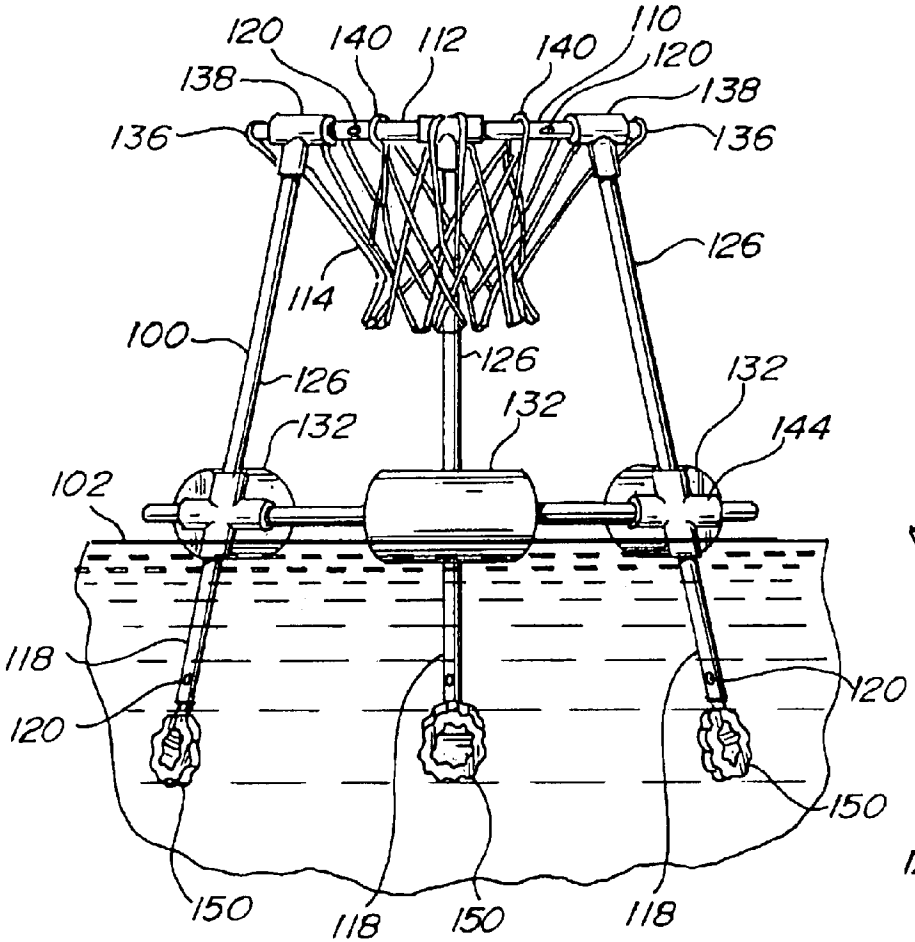
FIG. 1 is a side view of an apparatus according to the preferred embodiment of the invention in its basketball-playing orientation.

The Preferred embodiment of the invention is shown in FIGS. 1 though 7, where an apparatus 100 is depicted for floating on the water surface 102 and for use either with a ball 104 to play basketball with tossing rings 106 to play ringtoss.

Figure 7:
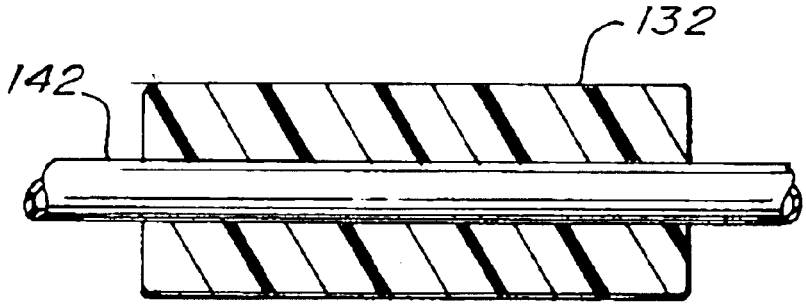
FIG. 7 is a cross-sectional view of a typical float of the apparatus of FIG. 1.
Figure 8:
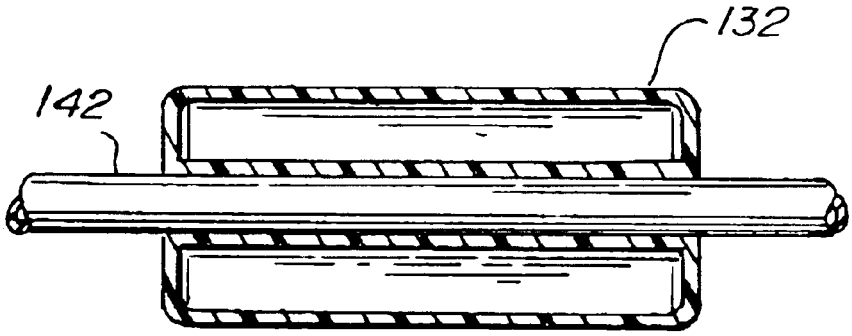
FIG. 8 is a cross-sectional view of an alternate embodiment of a typical float for use with the apparatus of FIG. 1

The apparatus consists of a basketball hoop portion 110, having a hoop ring 112 and a net 114, and a ringtoss portion comprising three ring posts 118. The hoop and ring portions are connected by a frame portion 124, which comprises three support posts 126 and a stability ring 128. The stability ring is disposed midway between the hoop and ringtoss portions at the center of floatation of the apparatus, and is equipped with three floats 132. The floats are preferably comprised of a closed-cell foam material for maximum and permanent buoyancy as depicted in FIG. 7, but they could alternatively be made of hollow blow-moldings as depicted in FIG. 8. The stability ring 128 and floats 132 rest directly on the water surface. The stability ring 128 is large in diameter to provide a stable footing for the apparatus on the water surface 102. At approximately nineteen and one-half inches, the stability ring 128 has a significantly larger diameter than the approximately sixteen inch diameter of the hoop ring 112 to provide a low center of stability, which is especially important during the rough play commonly encountered during basketball playing.

Figure 5:
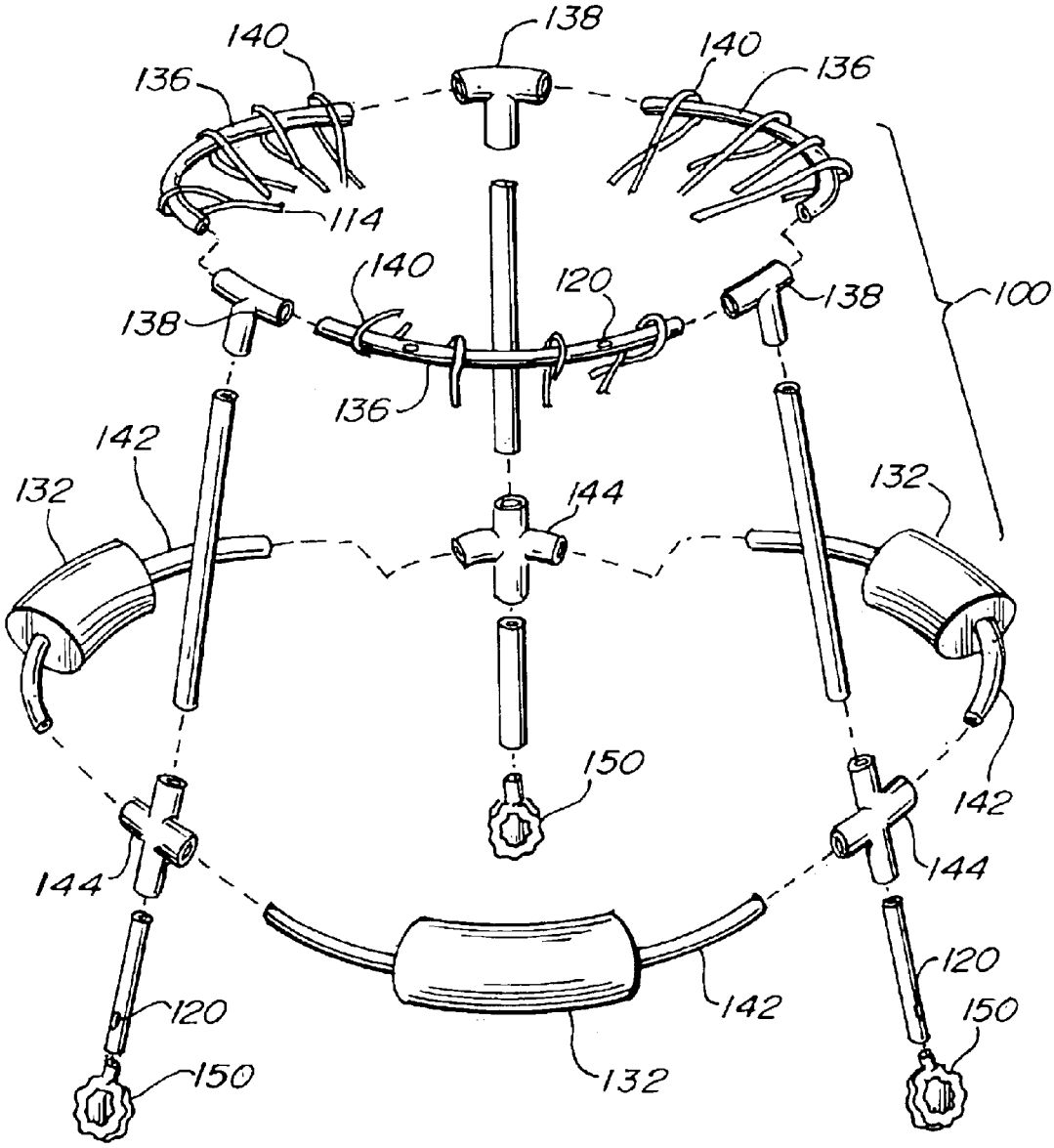
FIG. 5 is an exploded top perspective view of the apparatus of FIG. 1.
Figure 6:
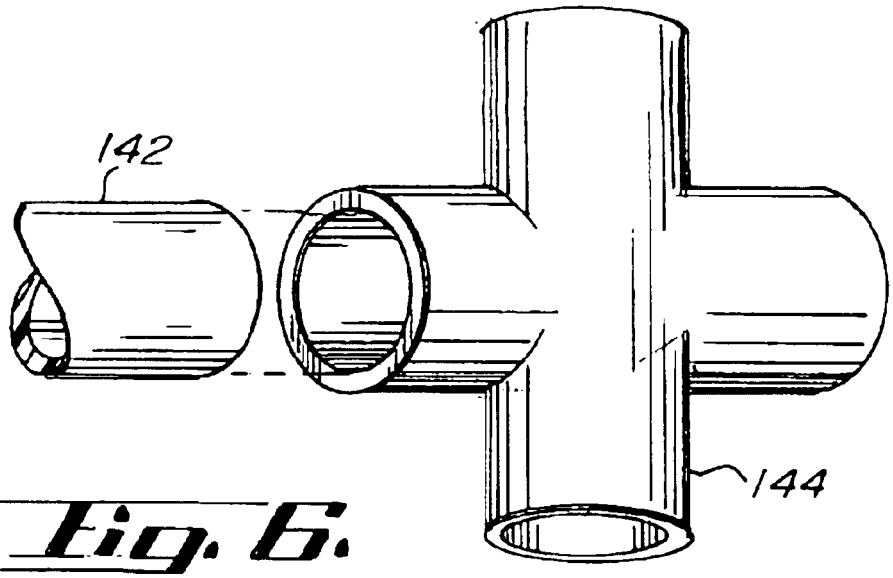

To minimize shipping volume, the apparatus is sold in a disassembled state and all components are fixed together by the end user. The hoop ring 112 comprises three arcuate hollow PVC hoop tubes 136, and three hollow polypropylene T-connectors 138. PVC is the preferred material for the posts because it is denser than water and therefore sinks, improving stability of the apparatus. The hoop tubes 136 are passed through loops 140 at the upper perimeter of the net 114 and inserted into the T-connectors as shown in FIG. 5 to form the hoop portion 110. PVC support posts 126 are then inserted into the T-connectors 138.

Figure 6:
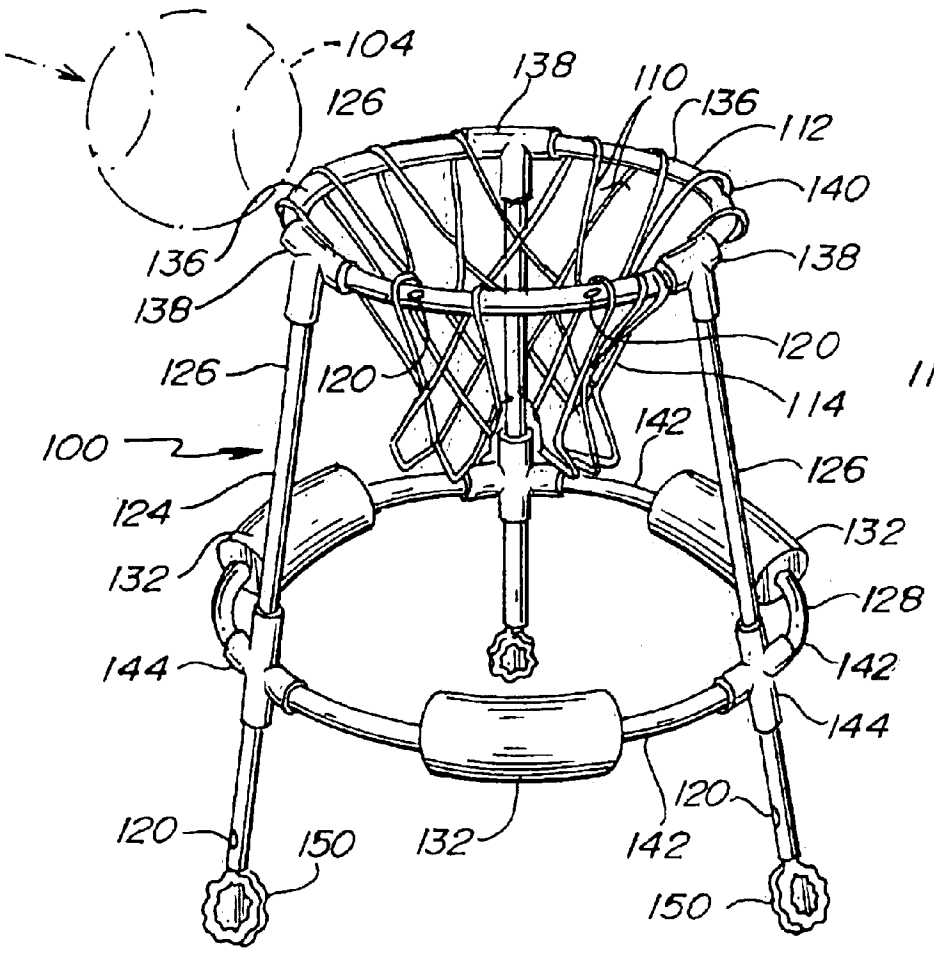
FIG. 6 is a partial exploded view of a typical joint assembly of the apparatus of FIG. 1.

Three arcuate hollow PVC main ring tubes 142 are provided with floats 132 pre-assembled thereto, as shown. The main ring tubes 142 are inserted into X-connectors 144, as typified by FIG. 6, to make-up the main ring 128, which is then connected to the support posts 126 by inserting the Support posts into the X-connectors 144, as shown.

Ring posts 118 are then inserted into the X-connectors 144 and three targets 150 are then attached to the ring posts 118.

Screws (not shown) are then driven through screw-holes (not shown) at each point of connection, to permanently secure the apparatus into its final configuration.

Considering first the use of apparatus 100 to play basketball, as shown in FIGS. 1 and 2, the apparatus is floated on the surface 102 of the water with the hoop portion 110 projecting upwardly, as shown in FIGS. 1 and 2. Vent holes 120 are positioned along each of the PVC tubes and posts to allow water to flow into the tubes and posts below the water surface and to allow air to flow into the tubes and posts above the water surface. At least one vent hole is disposed near to each of the hoop portion 110 and the ringtoss portion 116 to ensure that a vent hole is always disposed near to the top and bottom of the apparatus in either game-playing orientation. This not only stabilizes the apparatus to prevent inadvertent tip-over by lowering the apparatus' center of gravity, but it also is found to increase the inertia of the apparatus in the water to reduce inadvertent lateral movement from the intended location on the water surface. In effect, the apparatus is weighted below the water surface by the received water.

To play basketball, the ball 104 may now be thrown at the apparatus 100, in an attempt to score "baskets" by throwing the ball into the net 114.

Figure 3:
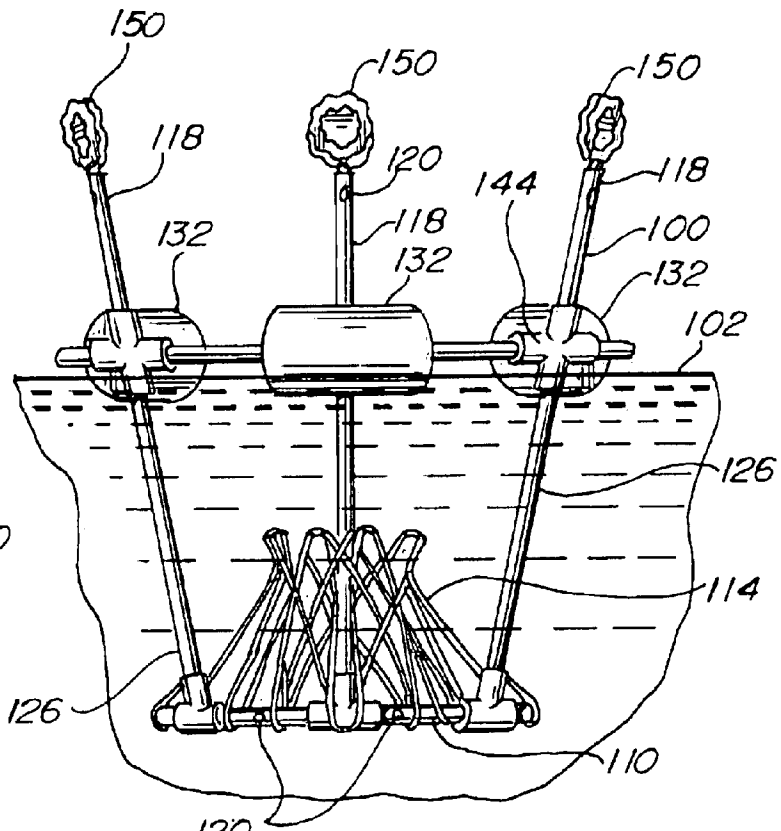
FIG. 3 is a side view of the apparatus of FIG. 1 in its ring toss-playing orientation.
Figure 4:
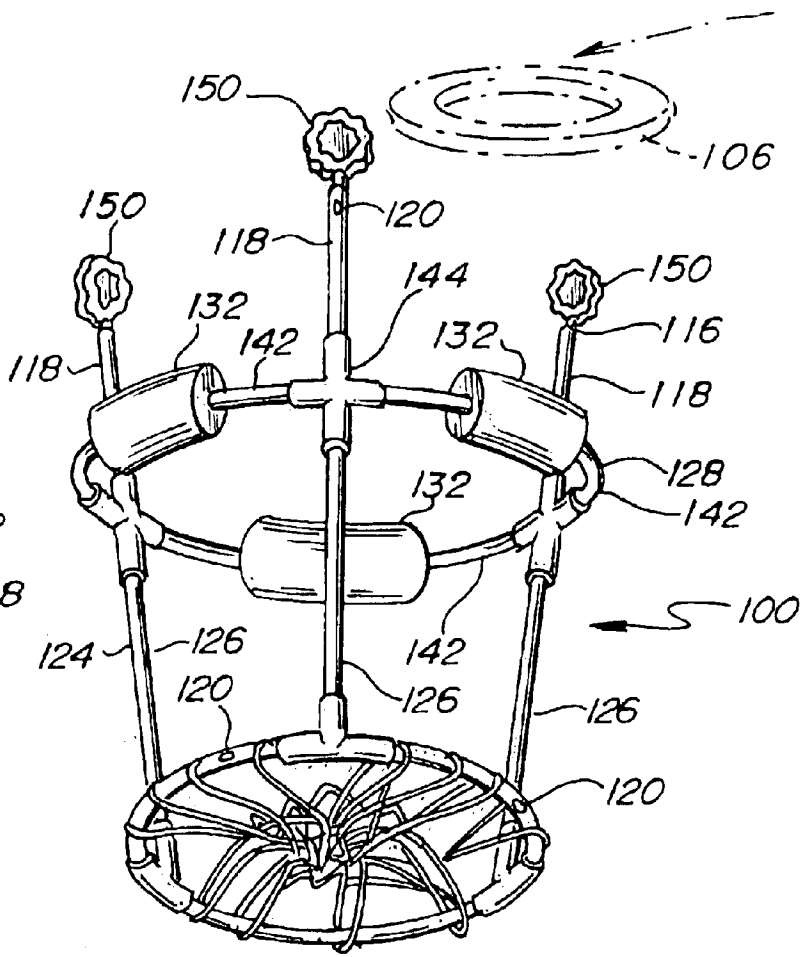
FIG. 4 is a top perspective view of the apparatus of FIG. 1 in its ring toss-playing orientation.

Considering next the use of apparatus 100 to play ringtoss, as shown in FIGS. 3 and 4, the apparatus is flipped top-to-bottom, so that the ring posts 118 project upwardly, and the apparatus is floated on the water surface 102 in that orientation. Water previously held within the ring posts drains downwardly into the now-lower hoop portion 110 as air enters through the vent holes 120 in the ring posts 118. Water is also received into the submerged portion of the apparatus through the vent holes 120 that are positioned evenly around the hoop ring 112 and along the support posts 126, to stabilize the apparatus in this new orientation.

To play ringtoss, the tossing rings 106 may be thrown at the apparatus 100, in an attempt to score "points" by throwing the rings over the targets 150 and onto the ring posts 118.

When play is over, the apparatus is removed from the water surface 102 and set aside to drain, so that all of the water within flows out through the vent holes 120 in the tubes and posts.

I will be appreciated by those skilled in the applicable arts that the foregoing is merely one of many possible embodiments of the invention, and that the invention should therefore only be limited according to the following claims.

I claim:

1. A buoyant apparatus for game-playing atop a water surface and comprising:

a first game portion disposed at a first end thereof, a second game portion disposed at a second end thereof, said second end being transversely disposed from said first end, a center of floatation disposed between said first and second ends such that said apparatus is adapted to float stably on the water surface with either of said ends directed upwardly, wherein said end floating upwardly is above the water surface and said other end is directed downwardly and below the water surface, and said ends comprise hollow portions adapted to allow water or air to flow there-into and there-from, and wherein said hollow portion of said end above the water surface is adapted to receive air and said hollow portion of said end below the water surface is adapted to receive water, thereby increasing the stability of the apparatus on the water surface, and said apparatus is comprised of a tubular structure having peripheral walls surrounding a hollow interior to comprise hollow portions, wherein said peripheral walls have vents there-through, said vents being adapted to receive air into said hollow interior at said end above the water surface and to receive water into said hollow interior at said end below said water surface, thereby increasing the stability of the apparatus on the water surface.

2. An apparatus according to claim 1 wherein said tubular structure further comprises a buoyant stability ring disposed substantially at said center of floatation, said stability ring being adapted to rest directly on the water surface and to stabilize the apparatus thereon.

3. An apparatus according to claim 2 wherein said first game portion comprises a basketball hoop and said second game portion comprises one or more ringtoss target posts.

4. An apparatus according to claim 3 wherein said basketball hoop comprises a hoop ring that is smaller in ring diameter than said stability ring.

5. An apparatus according to claim 4 wherein said tubular structure comprises said hoop ring and said one or more ringtoss target posts.

6. An apparatus according to claim 5 wherein said tubular structure is substantially comprised of PVC tubing.

7. An apparatus according to claim 6 wherein said stability ring comprises a PVC tubular ring portion and a float portion.

8. An apparatus according to claim 7 wherein said float portion comprises a plurality of buoyant floats disposed peripherally about said ring portion.

9. A floating apparatus for use in playing basketball and ringtoss on a water surface, said apparatus comprising:

a frusto-conical support frame comprising a first plurality of support posts disposed equally about a conical surface, said support posts connected at a minor end by a hoop ring and at a base end by a stability ring that is larger in ring diameter than said hoop ring, a second plurality of ringtoss target posts, equal to said first plurality, each target post extending coaxially from one of said support posts beyond said base end and oppositely from said minor end, and terminating at a ringtoss target, a plurality of buoyant floats disposed peripherally about said stability ring, wherein said support frame and target posts are comprised of interconnected hollow tubes having vents substantially adjacent said hoop ring and said target ends, and said apparatus is thereby adapted to be positioned with said floats disposed on the water surface with either the hoop ring directed upwardly for playing basketball, or with the ringtoss targets directed upwardly for playing ringtoss, and said support frame is adapted to receive water into said hollow tubes below the water surface through said vents and to receive air into said hollow tubes above the water surface through said vents, to thereby increase the stability of the apparatus on the water surface.

* * * * *